US007843337B2

(12) United States Patent
Maruoka et al.

(10) Patent No.: US 7,843,337 B2
(45) Date of Patent: Nov. 30, 2010

(54) HEARING AID

(75) Inventors: Kazutaka Maruoka, Ehime (JP); Akira Ochi, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/759,918

(22) Filed: Apr. 14, 2010

(65) Prior Publication Data

US 2010/0225479 A1 Sep. 9, 2010

Related U.S. Application Data

(63) Continuation of application No. PCT/JP2010/000720, filed on Feb. 5, 2010.

(30) Foreign Application Priority Data

Mar. 9, 2009 (JP) ..... 2009-054547
Jul. 30, 2009 (JP) ..... 2009-177368

(51) Int. Cl.
*G08B 21/00* (2006.01)

(52) U.S. Cl. ..... 340/540; 340/573.1; 340/521; 381/312

(58) Field of Classification Search ..... 340/540, 340/517, 521, 575, 506, 522, 573.1; 381/312, 381/313, 314, 315, 316, 323, 92
See application file for complete search history.

(56) References Cited

U.S. PATENT DOCUMENTS 4,689,820 A * 8/1987 Kopke et al. ..... 381/315
6,023,517 A * 2/2000 Ishige ..... 381/315
6,240,192 B1 * 5/2001 Brennan et al. ..... 381/314
7,738,665 B2 * 6/2010 Dijkstra et al. ..... 381/315
2008/0002032 A1 1/2008 Ito et al.

FOREIGN PATENT DOCUMENTS

| | | |
|---|---|---|
| EP | 2 164 282 | 3/2010 |
| JP | 56-172098 | 12/1981 |
| JP | 57-2799 | 1/1982 |
| JP | 2-57700 | 4/1990 |
| JP | 9-18997 | 1/1997 |
| JP | 2006-279409 | 10/2006 |
| JP | 2008-11474 | 1/2008 |
| WO | 2009/001559 | 12/2008 |

* cited by examiner

*Primary Examiner*—Anh V La
(74) *Attorney, Agent, or Firm*—Wenderoth, Lind & Ponack, L.L.P.

(57) ABSTRACT

This hearing aid comprises a microphone (1) for collecting sounds, an A/D converter (2) for converting an analog signal outputted from the microphone (1) into a digital signal, a hearing aid processor (3) for performing hearing aid processing on the digital signal outputted from the A/D converter (2), a D/A converter (4) for converting the signal that has undergone the hearing aid processing into an analog signal, and a receiver (5) for outputting the analog signal outputted from the D/A converter (4) as an acoustic signal to the surroundings. A mixer (6), in which a first input is connected to the output of the hearing aid processor (3) and its own output is connected to the input of the D/A converter (4), is interposed between the hearing aid processor (3) and the D/A converter (4). The output signal of an alert sound shaper (8) that shapes the alert sound signal produced by an alert sound producer (7) is connected to a second input of the mixer (6). The mixer (6) is connected to a controller (9) that produces a mix ratio signal for mixing the output signals of the hearing aid processor (3) and the alert sound shaper (8).

16 Claims, 5 Drawing Sheets

HEARING AID

This application is a Continuation of International Application No. PCT/JP2010/000720, filed Feb. 5, 2010.

TECHNICAL FIELD

The present invention relates to a hearing aid that emits an alert sound.

BACKGROUND ART

A conventional hearing aid comprises a microphone, a hearing aid processor for performing hearing aid processing on the sounds collected by the microphone, a receiver for outputting the output signal of this hearing aid processor as an acoustic signal, a memory for storing a voice message, a voice reproducer for reproducing this voice message, a battery for supplying electrical power to these components, and a voltage monitor for monitoring the voltage of the battery.

When the voltage matches a preset condition, a voice message stored in the memory is reproduced by the voice reproducer. The reproduced voice message is supplied to the receiver after being added to the output signal of the hearing aid processor (see Patent Citation 1, for example).

Consequently, the user can be alerted by voice that it is time to replace the battery when the battery voltage has dropped.

PRIOR ART PUBLICATIONS

Patent Citations

Patent Citation 1: Japanese Laid-Open Patent Application H9-018997

DISCLOSURE OF INVENTION

The technology discussed above is very effective as long as their is only one piece of information to convey to the user, that is, when there is only one kind of alert sound.

Meanwhile, more recent hearing aids come with more functions, and convey a wide variety of information to the user. These hearing aids vary the voice or sound rhythm depending on the information being conveyed. The user distinguish between these differences in voice or sound rhythm and thereby recognizes the information being conveyed by the hearing aid, so it is necessary for the user to be able to clearly distinguish between the various alert sounds.

Prior art, however, has not met that goal adequately. Specifically, with a conventional hearing aid, an alert sound is merely reproduced by adding to a voice signal that has undergone hearing aid processing. The frequency bands that are hard to hear will vary with the user, and for this and other reasons, a problem has been that some users cannot clearly hear the alert sound.

In view of this, it is an object of the present invention to improve the clarity of an alert sound regardless of the characteristics of each user.

To achieve this object, the hearing aid of the present invention comprises a microphone, an A/D converter, a hearing aid processor, a D/A converter, a receiver, an alert sound producer, an alert sound shaper, a mixer, and a controller. The microphone collects ambient sounds. The A/D converter converts an analog signal outputted from the microphone into a digital signal. The hearing aid processor performs hearing aid processing on the digital signal outputted from the A/D converter. The D/A converter converts the signal that has undergone the hearing aid processing into an analog signal. The receiver outputs the analog signal outputted from the D/A converter as an acoustic signal to the surroundings. The alert sound producer produces an alert sound according to a specific condition. The alert sound shaper shapes the alert sound signal produced by the alert sound producer. The mixer is provided between the hearing aid processor and the D/A converter, with a first input connected to the output of the hearing aid processor, and its own output connected to the input of the D/A converter. The output of the alert sound shaper, which shapes the alert sound signal produced by the alert sound producer, is connected to a second input of this mixer. The controller produces a mix ratio signal used by the mixer to combine the output signals of the hearing aid processor and the alert sound shaper in a specific mix ratio, and is connected to the mix ratio signal input terminal of the mixer. The alert sound shaper has a table converter, an alert gain decider, and a multiplier. The outputs a gain table used in the hearing aid processing of the hearing aid processor after converting for alert sound signal use. The alert gain decider decides an alert gain corresponding to an alert sound signal from the output signal of the table converter. The multiplier applies the alert gain outputted from the alert gain decider to the alert sound signal outputted from the alert sound producer.

This improves the clarity of the alert sound. Thus, the user can distinguish between a plurality of kinds of alert sound emitted by the hearing aid, and can properly recognize the information being conveyed.

Furthermore, the hearing aid of the present invention comprises a microphone, an A/D converter, a hearing aid processor, a D/A converter, a receiver, an alert sound producer, a mixer, and a controller. The microphone collects ambient sounds. The A/D converter converts an analog signal outputted from the microphone into a digital signal. The hearing aid processor performs hearing aid processing on the digital signal outputted from the A/D converter. The D/A converter converts the signal that has undergone the hearing aid processing into an analog signal. The receiver outputs the analog signal outputted from the D/A converter as an acoustic signal to the surroundings. The alert sound producer produces an alert sound according to a specific condition. The mixer is provided between the hearing aid processor and the A/D converter, with a first input connected to the output of the A/D converter, and its own output connected to the input of the hearing aid processor. The alert sound signal produced by the alert sound producer is inputted to a second input of this mixer. The controller produces a mix ratio signal used by the mixer to combine the output signals of the A/D converter and the alert sound producer in a specific mix ratio, and is connected to the mix ratio signal input terminal of the mixer.

The hearing aid processor has a frequency analyzer, a gain adjuster, a frequency combiner, a power calculator, and a gain controller. The frequency analyzer performs frequency analysis on the digital signal inputted to the hearing aid processor, and outputs the result as a frequency information signal. The gain adjuster adjusts the gain of the frequency information signal outputted from the frequency analyzer. The frequency combiner combines the frequency information signal that has undergone gain adjustment with the gain adjuster into a time axis signal. The power calculator inputs the frequency information signal outputted from the frequency analyzer, and calculates a power value for the digital signal inputted to the frequency analyzer from the frequency information signal. The gain controller inputs the power value outputted from the power calculator, and decides the gain at the gain adjuster on the basis of this power value and outputs it to the gain adjuster.

The gain controller has a table memory, a table selector, and a gain decider. The table memory stores a plurality of gain tables for performing hearing aid processing on ambient sounds collected by the microphone, and alert sound tables for performing hearing aid processing on the alert sound signals produced by the alert sound producer. The table selector reads from the table memory either the gain tables or the alert sound tables according to the mixing situation at the mixer. The gain decider decides the gain at the gain adjuster on the basis of the power value outputted from the power calculator by using the gain tables or the alert sound tables read by the table selector.

This improves the clarity of the alert sound. Thus, the user can distinguish between a plurality of kinds of alert sound emitted by the hearing aid, and can properly recognize the information being conveyed.

DESCRIPTION OF EMBODIMENTS

Embodiments of the present invention will now be described in detail along with the drawings.

Embodiment 1

Figure 1:
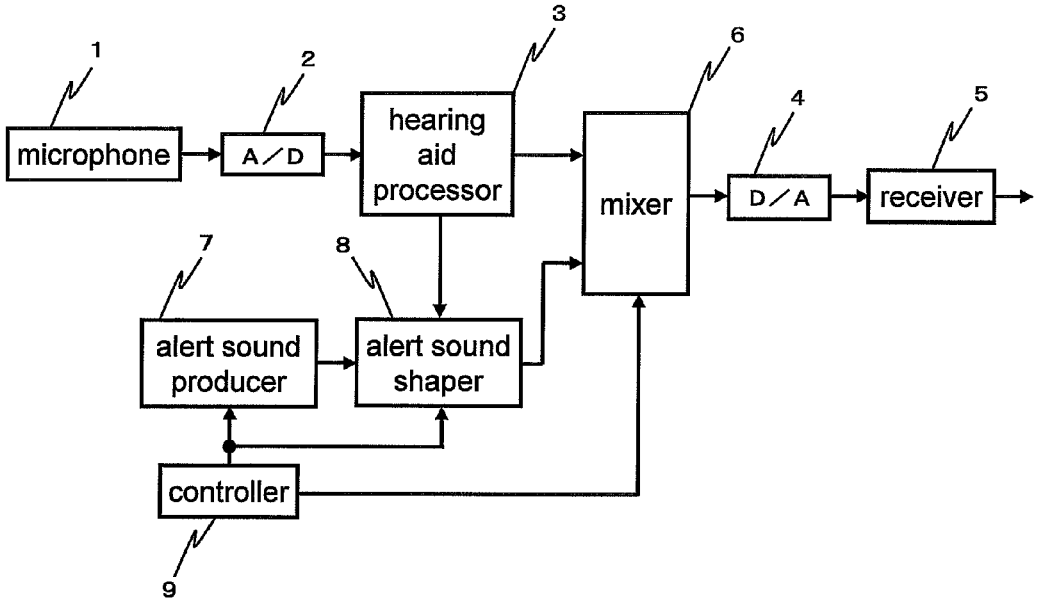
FIG. 1 is a function block diagram of the hearing aid pertaining to Embodiment 1 of the present invention.

First, the constitution of a hearing aid will be described through reference to FIG. 1. FIG. 1 is a function block diagram of the hearing aid.

The hearing aid of this embodiment, as shown in FIG. 1, comprises a microphone 1, an A/D (analog to digital) converter 2, a hearing aid processor 3, a D/A (digital to analog) converter 4, and a receiver 5.

The microphone 1 collects ambient sounds. The A/D converter 2 converts an analog signal outputted from the microphone 1 into a digital signal. The hearing aid processor 3 performs hearing aid processing on the digital signal outputted from the A/D converter 2. The D/A converter 4 converts the signal that has undergone the hearing aid processing into an analog signal. The receiver 5 outputs the analog signal outputted from the D/A converter 4 as an acoustic signal to the surroundings.

As shown in FIG. 1, the hearing aid of this embodiment further comprises a mixer 6 and a controller 9.

The mixer 6 is provided between the hearing aid processor 3 and the D/A converter 4, with a first input connected to the output of the hearing aid processor 3, and its own output connected to the input of the D/A converter 4. The output of an alert sound shaper 8, which shapes the alert sound signal produced by an alert sound producer 7, is connected to a second input of this mixer 6.

The controller 9 produces a mix ratio signal used by the mixer 6 to mix the output signals of the hearing aid processor 3 and the alert sound shaper 8 in a specific mix ratio, and is connected to the mix ratio signal input terminal of the mixer 6.

The microphone 1 collects ambient sound around the hearing aid, converts it into an analog electrical signal, and outputs this signal.

The A/D converter 2 converts the electrical signal outputted from the microphone 1 into a multi-bit digital signal and outputs it.

Figure 2:
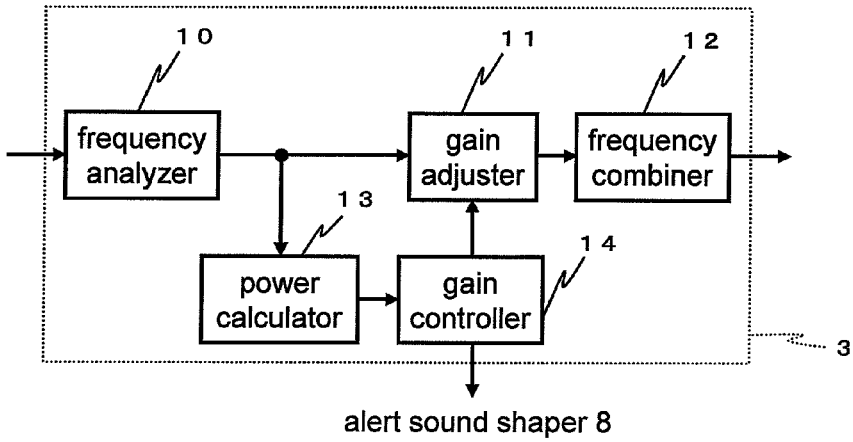
FIG. 2 is a function block diagram of the hearing aid processor of the same.

The configuration of the hearing aid processor 3 will now be described through reference to FIG. 2. FIG. 2 is a function block diagram of the hearing aid processor 3.

As shown in FIG. 2, the hearing aid processor 3 has a frequency analyzer 10, a gain adjuster 11, a frequency combiner 12, a power calculator 13, and a gain controller 14. The frequency analyzer 10 inputs the output signal of the A/D converter 2. The gain adjuster 11 performs gain adjustment on the output signal of this frequency analyzer 10. The frequency combiner 12 combines the signal inputted from the gain adjuster 11 into a time axis signal. The power calculator 13 calculates the power value outputted from the frequency analyzer 10. The gain controller 14 decides the gain for gain adjustment by the gain adjuster 11 on the basis of the power value outputted from this power calculator 13.

The frequency analyzer 10 converts the output signal of the A/D converter 2 inputted in time series from a time region signal into a frequency region signal. The frequency analyzer 10 splits the frequency region signal into a plurality of frequency regions and outputs a frequency information signal. This can be accomplished by splitting the result of a Fourier transformation, by subband splitting, or another such method.

The gain adjuster 11 multiplies the gain outputted from the gain controller 14 by the frequency information signal outputted from the frequency analyzer 10, and outputs the result.

The frequency combiner 12 combines the gain-adjusted frequency information signal outputted from the frequency analyzer 10 from a frequency region signal into a time region signal, and outputs a signal that has undergone hearing aid processing. This combination may be inverse Fourier transformation when the conversion by the frequency analyzer 10 is performed using Fourier transformation. On the other hand, subband combination may be employed when the above-mentioned conversion is performed using subband splitting.

The power calculator 13 calculates the power value for the frequency of each band of the frequency information signal outputted from the frequency analyzer 10, and outputs the result to the gain controller 14. The power value referred to here is the electrical power of the signal inputted to the frequency analyzer 10, and is correlated with the sound pressure level of the ambient sound collected by the microphone 1. That is, the lower is the sound pressure level, the lower is the power value, and the higher is the sound pressure level, the higher is the power value.

The gain controller 14 decides the gain with respect to the frequency information signal for each band on the basis of the power value for each band outputted from the power calculator 13. A gain table is used to decide the gain. The dynamic range of hearing varies from user to user, so nonlinear gain adjustment suited to each user is necessary for the inputted sound pressure level. In view of this, a gain table listing the gain for each power value is produced on the basis of the gain characteristics needed for a user as determined by audiogram or the like. The gain controller 14 decides the gain by referring to this gain table, and outputs the decided gain to the gain adjuster 11. Furthermore, this gain table is outputted to the alert sound shaper 8.

A plurality of kinds of these gain tables are readied, each being partially different from the others, using the required gain characteristics for a user as a reference. For example, if the user is in a noisy environment, this noise is reduced, or wind roar during movement is reduced. In this embodiment, three types are readied: a gain table A that takes into account only the gain characteristics of the user, a gain table B used in noisy situations, and a gain table C used during movement. A control signal (not shown) from the controller 9 switches between these tables.

These gain tables are produced ahead of time by a fitting apparatus or other such external device, and are stored in a memory (not shown) inside the hearing aid. The gain controller 14 extracts the desired gain table from the memory and refers to it, according to a switching command from the outside.

We will now return to FIG. 1 to describe the mixer 6.

The mixer 6 inputs a signal that has undergone hearing aid processing and has been outputted from the hearing aid processor 3, and a signal outputted from the alert sound shaper 8. The mixer 6 mixes these input signals on the basis of a mix ratio signal outputted from the controller 9 connected to a mix ratio signal input terminal, and outputs the result to the D/A converter 4. For instance, if we assume a mix ratio of 0:10 between the output signal of the hearing aid processor 3 and the output signal of the alert sound shaper 8, then only the output signal of the alert sound shaper 8 is outputted. If the mix ratio is 5:5, for example, then the output signal of the hearing aid processor 3 and the output signal of the alert sound shaper 8 are mixed at the same level and outputted. This mix ratio can be set according to the user's preferences during fitting or the like.

The D/A converter 4 converts the multi-bit digital signal outputted from the mixer 6 into an analog signal and outputs it to the receiver 5.

The receiver 5 is a speaker that converts the analog signal outputted from the D/A converter 4 into an acoustic signal and outputs it to the surroundings.

Next, the alert sound producer 7 and the alert sound shaper 8 will be described.

The alert sound producer 7 produces an alert sound according to a command from the controller 9, and outputs it as an alert sound signal. This alert sound signal is made up of monotones in a predetermined alert pattern.

In this embodiment, a "pee-, pee-" sound with a frequency of 2 kHz is produced as alert pattern A, a "peep" sound of 1 kHz as alert pattern B, a "peep, peep" sound of 1 kHz as alert pattern C, and a "peep, peep, peep" sound 1 kHz as alert pattern D. The volume is the same for all of these alert sound signals, at 110 dB SPL.

Figure 3:
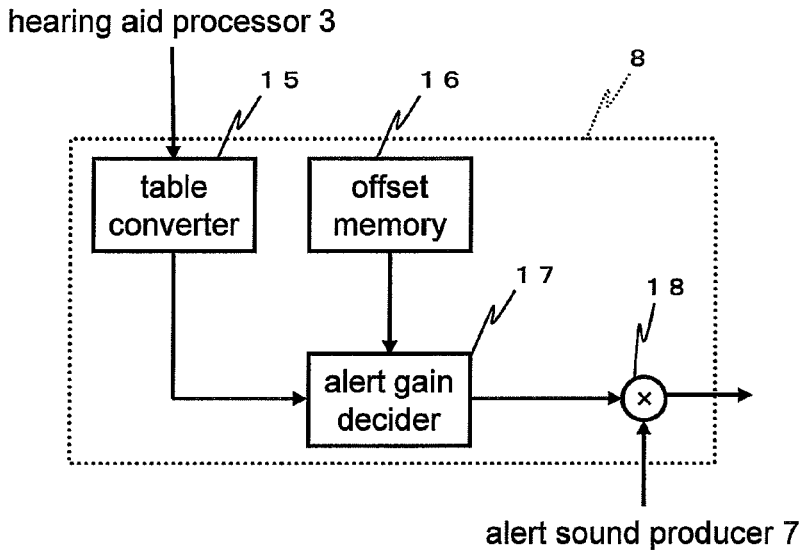
FIG. 3 is a function block diagram of the alert sound shaper of the same.

Next, the configuration of the alert sound shaper 8 will be described through reference to FIG. 3. FIG. 3 is a function block diagram of the alert sound shaper 8.

As shown in FIG. 3, the alert sound shaper 8 comprises a table converter 15, an offset memory 16, an alert gain decider 17, and a multiplier 18. The table converter 15 converts the gain table used in hearing aid processing by the hearing aid processor 3 into alert sound signal use, and outputs the result. The offset memory 16 stores an offset amount for adding a different characteristic for each alert sound signal. The alert gain decider 17 decides the alert gain according to the alert sound signal on the basis of the output signal of the table converter 15 and the offset amount outputted from the offset memory 16. The multiplier 18 applies the alert gain outputted from this alert gain decider 17 to the alert sound signal outputted from the alert sound producer 7.

A gain table that takes into account only the gain characteristics of the user (in this embodiment, gain table A) is inputted from the gain controller 14 inside the hearing aid processor 3 to the table converter 15. The table converter 15 extracts from this a gain corresponding to the band of the alert sound signal produced by the alert sound producer 7, produces an alert sound table, and outputs to the alert gain decider 17. In this embodiment, gains of 1 and 2 kHz are selected from the gain table A to produce the alert sound table.

The offset memory 16 stores offset values corresponding to various alert patterns, which are values multiplied by the volume of the alert sound signal. For example, we will assume that the offset value of alert pattern A is 0.8, and the offset value of alert patterns B, C, and D is 0.5. An offset value corresponding to the alert sound signal produced by the alert sound producer 7 is outputted to the alert gain decider 17 at a command (not shown) from the controller 9.

The alert gain decider 17 selects from the alert sound table the gain corresponding to the volume obtained by multiplying the offset value with the volume of the alert sound signal on the basis of a command (not shown) from the controller 9, and this selected gain and the offset value are outputted as alert gain to the multiplier 18.

With a hearing aid that has a volume adjustment function, the volume value set in this alert gain decider 17 is inputted and is multiplied by the offset value. The alert gain decider 17 selects a gain on the basis of the offset value multiplied by this volume value, and outputs the offset value multiplied by this volume value to the multiplier 18.

The multiplier 18 multiplies the offset value and the gain outputted from the alert gain decider 17 by the alert sound signal outputted from the alert sound producer 7, and outputs the result. In this way, the output from the multiplier 18 changes the volume and frequency for each alert sound signal, and this volume is adjusted to suit the gain characteristics of the user.

At this point the alert gain decider 17 clips the selected gain and offset value so that the volume of the alert sound signal outputted from the multiplier 18 will be neither too loud nor too soft. This is done so that the user will recognize the alert sound reliably and comfortably, and is particularly important with a hearing aid equipped with a volume control.

Specifically, an alert sound that is too loud is unpleasant for the user, but if the sound is too soft the user may not catch it. To prevent these, the alert gain decider 17 adjusts the gain and offset value so that the volume of the alert sound signal outputted from the multiplier 18 falls within a specific range. For example, if the volume of the input signal to the multiplier 18 is 110 dB SPL, the adjustment is made so that the volume of the output signal to the multiplier 18 will fall within a range of 40 to 80 dB SPL.

We will now return to FIG. 1 to describe the controller 9.

The controller 9 outputs commands to output an alert sound signal and to select an alert pattern to the alert sound producer 7 and the alert sound shaper 8 when an alert is conveyed to the user. The controller 9 outputs a select signal to the mixer 6 so that the alert sound signal outputted from the alert sound shaper 8 is selected. Furthermore, the controller 9 outputs a control signal (not shown) to the hearing aid processor 3 for switching between the gain tables A to C.

The selection of the alert pattern and the decision of the timing at which this alert is performed are carried out as follows.

When the remaining power of the power supply that supplies power to the various electrical parts of this hearing aid drops below a specific value, alert pattern A is selected. The gain controller 14 selects alert pattern B when the gain table to be used is switched to gain table A, alert pattern C when the switch is to gain table B, and alert pattern D when the switch is to gain table C.

With the above constitution, usually, when no alert is to be conveyed to the user, the sound collected by the microphone 1 is subjected to hearing aid processing and outputted from the receiver 5. If an alert is to be conveyed to the user, on the other hand, this sound that has undergone hearing aid processing is mixed with sound produced by the alert sound producer 7 that has undergone the same extent of processing as the hearing aid processing, and the result is outputted from the receiver 5.

Thus, in this embodiment, alert sounds with different frequency and volume are provided for each type of information to be conveyed to the user. Consequently, the clarity of the alert sounds is improved, and the user is able to distinguish between a plurality of kinds of alert sound of the hearing aid. Thus, the user can properly recognize the information being conveyed.

Embodiment 2

Figure 4:
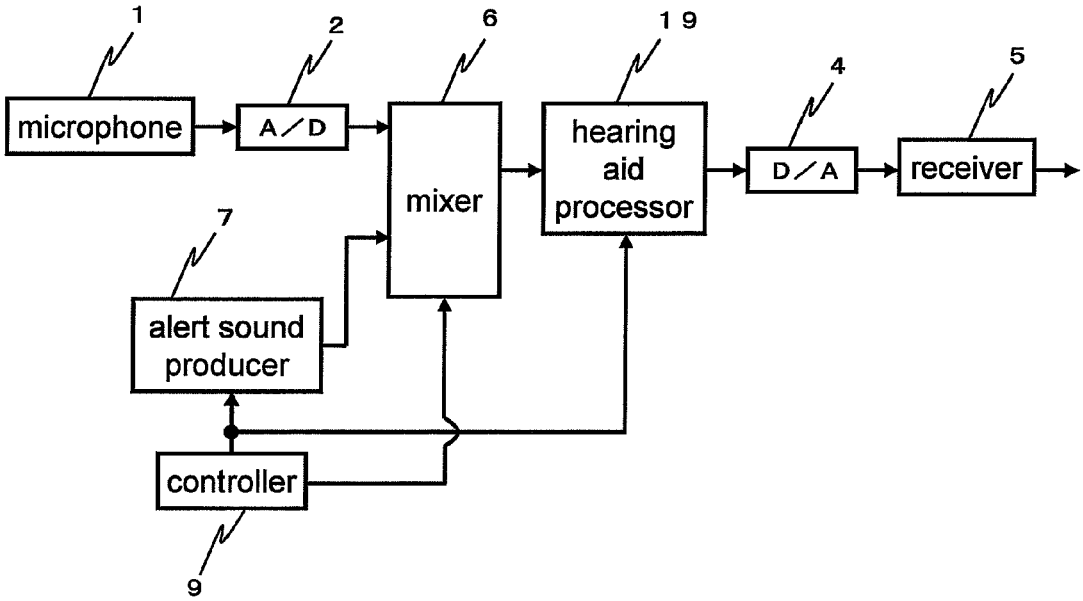
FIG. 4 is a function block diagram of the hearing aid pertaining to Embodiment 2 of the present invention.

First, the constitution of the hearing aid of this embodiment will be described through reference to FIG. 4. FIG. 4 is a function block diagram of the hearing aid.

As shown in FIG. 4, the hearing aid of this embodiment comprises the microphone 1, the A/D converter 2, a hearing aid processor 19, the D/A converter 4, and the receiver 5. The microphone 1 collects ambient sounds. The A/D converter 2 converts an analog signal outputted from the microphone 1 into a digital signal. The hearing aid processor 19 performs hearing aid processing on the digital signal outputted from the A/D converter 2. The D/A converter 4 converts the signal that has undergone the hearing aid processing into an analog signal. The receiver 5 outputs the analog signal outputted from the D/A converter 4 as an acoustic signal to the surroundings.

The hearing aid of this embodiment further comprises the mixer 6 and the controller 9. The mixer 6 is provided between the A/D converter 2 and the hearing aid processor 19, with a first input connected to the output of the A/D converter 2, and its own output connected to the input of the hearing aid processor 19. An alert sound signal produced by the alert sound producer 7 is inputted to a second input of this mixer 6. The controller 9 produces a mix ratio signal used by the mixer 6 to mix the output signals of the A/D converter 2 and the alert sound producer 7, and is connected to the mix ratio signal input terminal of the mixer 6.

The only difference in this embodiment from the constitution of Embodiment 1 given above is that the mixer 6 that mixes and outputs the output signal of the A/D converter 2 and the output signal of the alert sound producer 7 is provided at a point ahead of the hearing aid processor 19.

More specifically, when a mix ratio signal is outputted from the controller 9, the mixer 6 mixes the output signal of the A/D converter 2 with the output signal of the alert sound producer 7 and supplies the result to the hearing aid processor 19. Just the hearing aid processor 19 is accordingly different in its constitution and operation. Thus, the rest of the components will be numbered the same and not described again.

Figure 5:
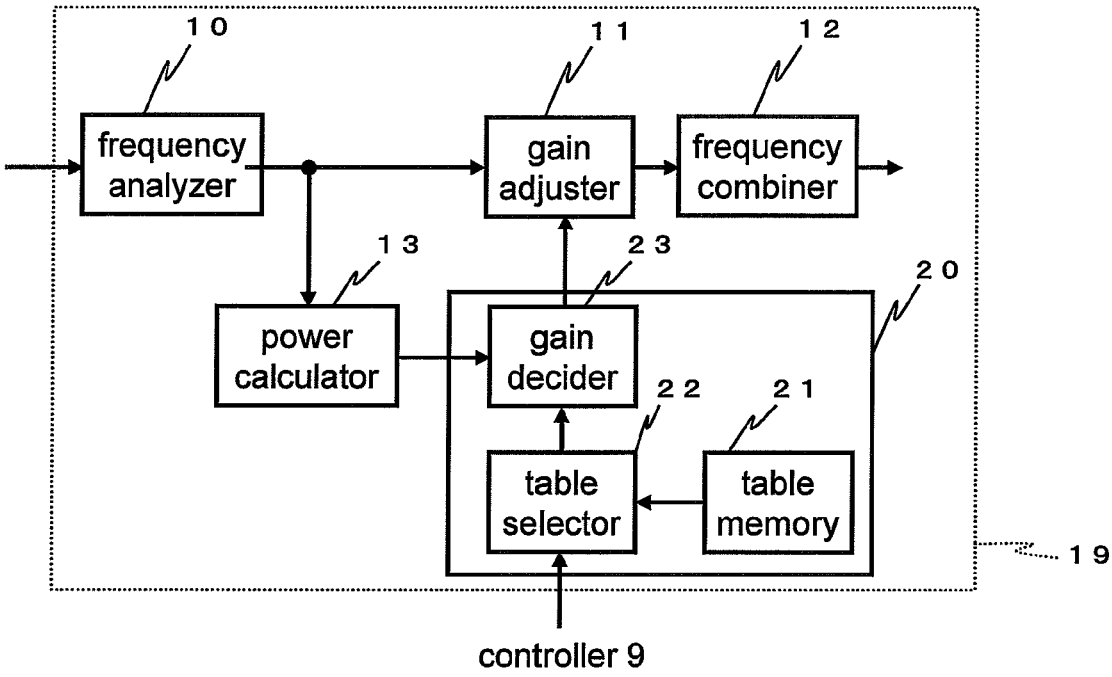
FIG. 5 is a function block diagram of the hearing aid processor of the same.

Next, the configuration of the hearing aid processor 19 will be described through reference to FIG. 5. FIG. 5 is a function block diagram of the hearing aid processor 19.

As shown in FIG. 5, the hearing aid processor 19 comprises the frequency analyzer 10, the gain adjuster 11, the frequency combiner 12, the power calculator 13, and a gain controller 20. The frequency analyzer 10 performs frequency analysis on the digital signal inputted to the hearing aid processor 19, and outputs the result as a frequency information signal. The gain adjuster 11 adjusts the gain of the frequency information signal outputted from the frequency analyzer 10. The frequency combiner 12 combines the frequency information signal that has undergone gain adjustment by the gain adjuster 11 into a time axis signal. The power calculator 13 inputs the frequency information signal outputted from the frequency analyzer 10, and calculates the power value outputted of the digital signal that is inputted to the frequency analyzer 10 from this frequency information signal. The gain controller 20 inputs the power value outputted from the power calculator 13, decides the gain at the gain adjuster 11 on the basis of this power value, and outputs the result to the gain adjuster 11.

The gain controller 20 further has a table memory 21, a table selector 22, and a gain decider 23. The table memory 21 stores a plurality of gain tables for performing hearing aid processing on ambient sounds collected by the microphone 1, and alert sound tables for performing hearing aid processing on the alert sound signals produced by the alert sound producer 7. The table selector 22 reads from the table memory 21 either the gain tables or the alert sound tables according to the mixing situation at the mixer 6. The gain decider 23 uses the gain tables or the alert sound tables read by the table selector 22 to decide the gain at the gain adjuster 11 on the basis of the power value outputted from the power calculator 13.

Thus, the difference in the hearing aid processor 19 from Embodiment 1 above is in the constitution and operation of the gain controller 20. Therefore, components other than the gain controller 20 will be numbered the same and not described again.

First, a plurality of gain tables used by the gain decider 23 to decide the gain used by the gain adjuster 11 are stored in the table memory 21. In this embodiment, just as in Embodiment 1 above, we will assume that three gain tables A to C and four alert sound tables A to D are stored.

The alert sound tables A to D correspond to the alert patterns A to D outputted from the alert sound producer 7. These alert sound tables A to D are produced ahead of time by a fitting apparatus or other such external device, and are stored in the table memory 21, just as with the gain tables A to C, etc. The algorithm by which these alert sound tables A to D are produced by the external device is the same as the operation of the alert sound shaper 8 in Embodiment 1 above.

Specifically, from the gain table A, algorithms the same as the operation of the table converter 15, the offset memory 16, and the alert gain decider 17 are used to produce the alert sound tables A to D corresponding to alert patterns A to D.

The table selector 22 selects one gain table from among the gain tables A to C and the alert sound tables A to D on the basis of a command from the controller 9, this is table out of the table memory 21, and outputs it to the gain decider 23.

The gain decider 23 performs the same operation as the gain controller 14 in Embodiment 1 above when what the table selector 22 selects is one of the gain tables A to C. However, if the table selector 22 has selected one of the alert sound tables A to D, then the operation is the same as part of the operation of the alert gain decider 17 in Embodiment 1 above.

Specifically, when gain is selected by referring to an alert sound table on the basis of the power value outputted from the power calculator 13, and this gain is applied at the gain adjuster 11, the gain is clipped so that the volume of the signal outputted from the frequency combiner 12 will fall within a specific range. If the hearing aid is equipped with a volume control, this volume is also taken into account in selecting the gain.

With the above constitution, usually, when no alert is to be conveyed to the user, the sound collected by the microphone 1 is subjected to hearing aid processing and outputted from the receiver 5. If an alert is to be conveyed to the user, on the other hand, the alert sound signal produced by the alert sound producer 7 is selected and inputted to the hearing aid processor 19 instead of the sound collected by the microphone 1, and this is subjected to the same extent of processing as the hearing aid processing and outputted from the receiver 5.

Thus, in this embodiment, alert sounds with different frequency and volume are provided for each type of information to be conveyed to the user. Consequently, the clarity of the alert sounds is improved, and the user is able to distinguish between a plurality of kinds of alert sound of the hearing aid. Thus, the user can properly recognize the information being conveyed.

In this embodiment, an example was given in which alert sound tables were produced by an external device and stored ahead of time, but gain tables may instead by converted every time to produce an alert sound table, just as in Embodiment 1 above. In this case, the blocks of the alert sound shaper 8 shown in Embodiment 1 above may be provided inside the gain controller 20.

Embodiment 3

Next, the constitution of a hearing aid in which the volume of an alert sound is adjusted according to the sound pressure level of the ambient sound will be described through reference to FIGS. 1 and 6.

The hearing aid in this embodiment differs from Embodiment 1 above in that, regarding the function blocks of the hearing aid shown in FIG. 1, the digital signal outputted from the A/D converter 2 is also inputted to the alert sound producer 7.

The alert sound producer 7 subjects the digital signal outputted from the A/D converter 2 to frequency analysis just as with the frequency analyzer 10 and the power calculator 13 shown in FIG. 2, after which the power value is calculated for each band. The alert sound producer 7 then sums the power values for all bands to find the sound pressure level of ambient sound, and decides the sound pressure level of the alert sound signal to be produced according to the sound pressure level thus found.

Figure 6:
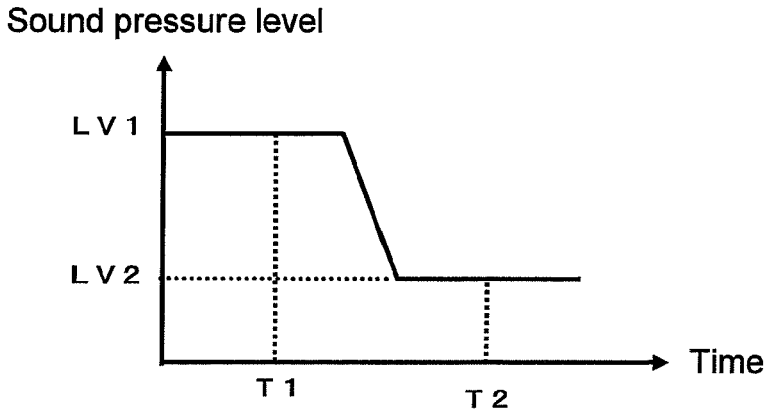
FIG. 6 is a graph of the sound pressure level of ambient sound versus the time axis.

FIG. 6 is a graph of the change in the sound pressure level of ambient sound found by the alert sound producer 7 on the time axis. For example, if alert sound generation is needed at time T1, an alert sound signal is produced so that the volume of the alert pattern selected at a command from the controller 9 will be LV1 dB SPL.

If alert sound generation is needed at time T2, an alert sound signal is produced so that the volume of the alert pattern will be LV2 dB SPL. The alert sound signal that is produced is outputted to the alert sound shaper 8.

Thus adjusting the volume of the alert sound signal according to the sound pressure level of the ambient sound prevents fluctuation in the ease of hearing an alert sound according to the volume of ambient sound.

In this example, the sound pressure level of ambient sound and the volume of the alert pattern were set to the same level, but that is not necessary, and the volume of the alert pattern may be varied so as to be proportional to the sound pressure level of ambient sound, according the hearing ability and preference of the user.

As to the volume of the alert pattern, it may be adjusted by clipping so that the alert sound signal produced is neither too loud nor too soft.

In this embodiment, a power value calculated by a power calculator included in the hearing aid processor 3 may be inputted to the alert sound producer 7 instead of a power value for each frequency band in the digital signal outputted from the A/D converter 2 by the alert sound producer 7.

Similarly, with the hearing aid shown in FIG. 4, the digital signal outputted from the A/D converter 2 may be outputted to the alert sound producer 7, an alert sound signal with a volume corresponding to the sound pressure level of ambient sound may be produced by the alert sound producer 7, and the produced alert sound signal may be outputted to the mixer 6. Here again, this prevents fluctuation in the ease of hearing an alert sound according to the volume of ambient sound.

Embodiment 4

Next, a hearing aid with which the frequency of an alert sound is decided according to the frequency of ambient sound will be described through reference to FIGS. 1 and 7.

The hearing aid in this embodiment differs from Embodiment 1 above in that, regarding the function blocks of the hearing aid shown in FIG. 1, the digital signal outputted from the A/D converter 2 is also inputted to the alert sound producer 7.

The alert sound producer 7 subjects the digital signal outputted from the A/D converter 2 to frequency analysis just as with the frequency analyzer 10 and the power calculator 13 shown in FIG. 2, after which the power value is calculated for each band and a frequency distribution is produced. A band in which no sound has been generated, or the power value of the sound is low, is detected from the frequency distribution thus produced, and an alert sound signal is produced so that the frequency of the alert pattern selected at a command from the controller 9 will be within this band.

That is, if the frequency of the selected alert pattern does not overlap the frequency of ambient sound, an alert sound signal of the selected alert pattern is produced directly. On the other hand, if these frequencies do overlap, the frequency of the alert pattern is shaped and an alert sound signal produced so that there is no overlap. More specifically, the frequency of the alert pattern is shaped so that the lowest incidence of frequency distribution within a specific range is achieved, using the frequency of the selected alert pattern as the center.

Figure 7:
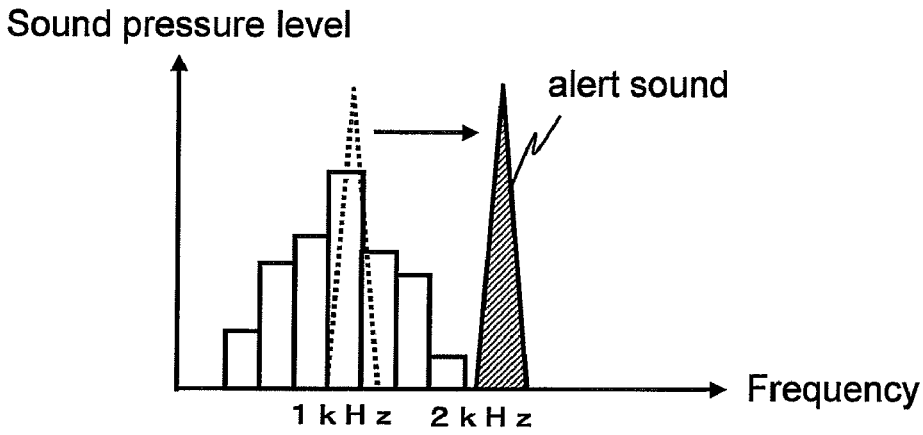
FIG. 7 is a graph of an alert sound and ambient sound over a frequency band.

FIG. 7 is a graph of the frequency distribution produced by the alert sound producer 7. In FIG. 7, digital signals over a specific sound pressure level are clustered around 1 kHz, and the band above 2 kHz is small. In this case, when the frequency of the alert pattern first selected is 1 kHz, an alert sound signal shaped to a band of 2 kHz or higher is produced. The alert sound signal thus produced is outputted to the alert sound shaper 8.

Thus deciding the frequency an alert sound according to the frequency of ambient sound makes it easier for the user to hear the alert sound, without it being buried in the frequency band of the ambient sound.

In the shaping of the frequency of the alert pattern, if the occurrences of a specific frequency range are all over a specific value, that is, if the sound pressure level for all bands is high, then the volume of the alert sound may be adjusted according to the sound pressure level of the ambient sound just as in Embodiment 3 above.

Also, in this embodiment, a power value calculated by a power calculator included in the hearing aid processor 3 may be inputted to the alert sound producer 7 instead of a power value for each frequency band in the digital signal outputted from the A/D converter 2 by the alert sound producer 7.

Also, just as with the hearing aid shown in FIG. 4, the digital signal outputted from the A/D converter 2 may be outputted to the alert sound producer 7, an alert sound signal may be produced by the alert sound producer 7 so that its frequency is different from that of the ambient sound, and the produced alert sound signal may be outputted to the mixer 6. Here again, this makes it easier for the user to hear the alert sound, without it being buried in the frequency band of the ambient sound.

Embodiment 5

Next, a hearing aid in which the timing of alert sound generation is adjusted according to the sound pressure level of ambient sound will be described through reference to FIGS. 1 and 8.

The hearing aid in this embodiment differs from Embodiment 1 above in that, regarding the function blocks of the hearing aid shown in FIG. 1, the digital signal outputted from the A/D converter 2 is also inputted to the alert sound producer 7.

The alert sound producer 7 subjects the digital signal outputted from the A/D converter 2 to frequency analysis just as with the frequency analyzer 10 and the power calculator 13 shown in FIG. 2, after which the power value is calculated for each band. The alert sound producer 7 finds the sound pressure level of the ambient sound by summing the power values for all bands, and produces an alert sound signal and generates an alert sound at the timing at which the sound pressure level thus found is below a specific level.

Figure 8:
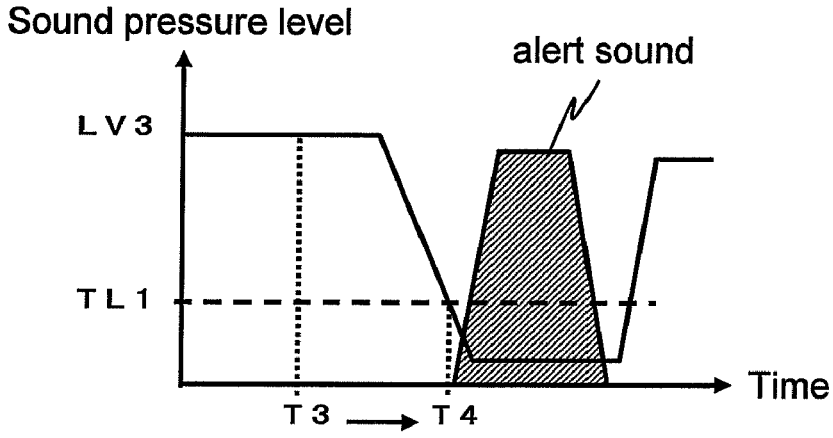
FIG. 8 is a graph of the sound pressure levels of an alert sound and ambient sound versus the time axis.

FIG. 8 is a graph of the alert sound generation timing and the change in sound pressure level of ambient sound found by the alert sound producer 7, on the time axis. T3 is the intended alert sound generating timing, and T4 is the timing at which the alert sound was actually generated.

First, when a command to produce an alert sound arrives from the controller 9, the calculated sound pressure level of ambient sound is confirmed (T3). If the sound pressure level at this point is high (LV3 dB SPL), no alert sound signal is produced. When no alert sound signal is produced, the sound pressure level of ambient sound continues to be monitored. An alert sound signal is produced (T4) at the timing at which the sound pressure level drops under TL1 dB SPL, which is set ahead of time as a level at which there is little ambient sound effect.

In monitoring the sound pressure level of ambient sound, it is preferable for there to be a time limit so that no problems are encountered such as the generating timing being too late.

After the alert sound signal thus produced has been outputted to the alert sound shaper 8 and shaped, this alert sound signal is mixed by the mixer 6 with the output signal outputted from the hearing aid processor 3 at the timing at which the shaped alert sound signal was inputted, and this mixed signal is outputted to the D/A converter 4.

Thus generating an alert sound at a timing at which the sound pressure level of ambient sound is low allows the alert sound to be generated at a timing at which the surroundings are quiet, and allows the generation of an alert sound that is easy for the user to hear.

Also, rather than using the sound pressure level of ambient sound to confirm the timing of alert sound production, the alert sound producer 7 may use whether or not the ambient sound is voice, and the alert sound signal may be produced at a timing at which there is no voice. This voice evaluation can be accomplished by subjecting the digital signal outputted from the A/D converter 2 to cepstrum analysis, and making a determination from the extracted characteristic quantity.

Thus generating the alert sound at a timing at which the ambient sound is non-voice allows the alert sound to be generated without disrupting the conversation of the user.

Also, if the alert sound producer 7 generates an alert sound under a time limit, then the volume of the alert sound may be adjusted according to the sound pressure level of the ambient sound just as in Embodiment 3 above, or the frequency of the alert sound may be adjusted according to the frequency of the ambient sound just as in Embodiment 4 above.

In this embodiment, a power value calculated by a power calculator included in the hearing aid processor 3 may be inputted to the alert sound producer 7 instead of a power value for each frequency band in the digital signal outputted from the A/D converter 2 by the alert sound producer 7

Similarly, with the hearing aid shown in FIG. 4, the digital signal outputted from the A/D converter 2 may be outputted to the alert sound producer 7, and the timing at which the alert sound is generated may be decided by the alert sound producer 7. Here again, the alert sound can be generated at a timing at which the surroundings are quiet, and an alert sound that is easy for the user to hear can be generated.

Embodiment 6

Figure 9:
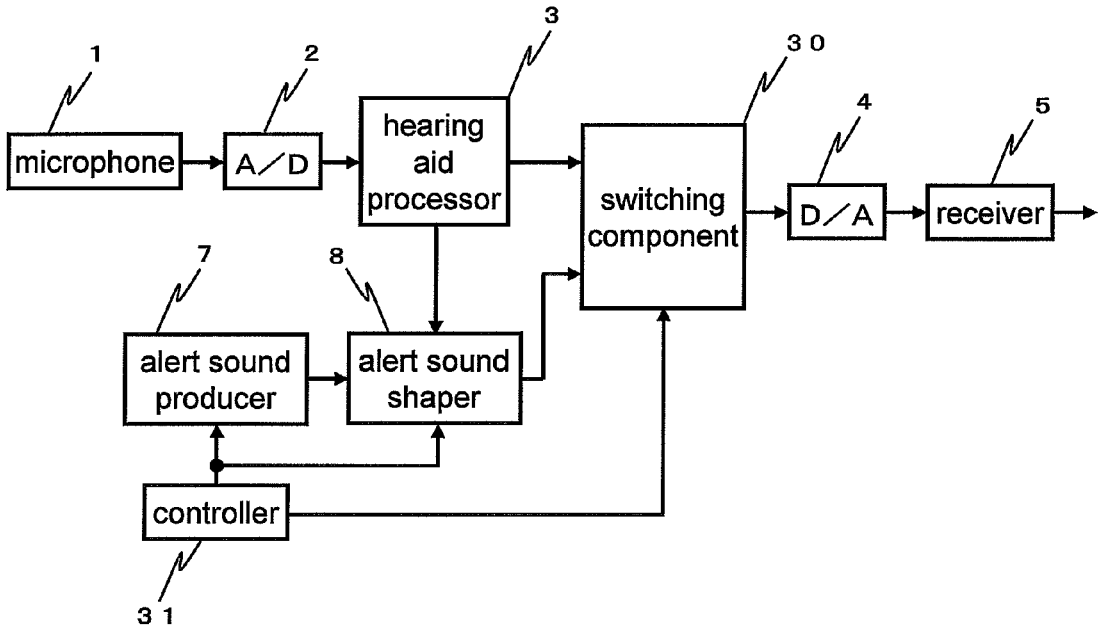
FIG. 9 is a function block diagram of the hearing aid pertaining to Embodiment 6 of the present invention.

First, the constitution of a hearing aid will be described through reference to FIG. 9.

In this embodiment, a switching component 30 and a controller 31 are different from Embodiment 1 above. Specifically, the switching component 30 is provided in place of the mixer 6. The controller 31 is numbered separately from the mixer 6 because it operates differently. The rest of the constituent elements are the same as in Embodiment 1 and will therefore not be described again.

The switching component 30 has at least three input components and one output component. Of the three or more input components, the first input component is connected to the output of the hearing aid processor 3. The second input component is connected to the output of the alert sound shaper 8 that shapes the alert sound signal produced by the alert sound producer 7. The third input component is connected to the output of the controller 31 that selects the output of the hearing aid processor 3 or the alert sound shaper 8 and decides whether to output. The output component of the switching component 30 is connected to the D/A converter 4.

The controller 31 normally controls so the output of the hearing aid processor 3 is selected and the voice signal inputted from the microphone 1 is outputted. On the other hand, if an alert sound has been outputted from the alert sound producer 7, the controller 31 controls so that the output of the alert sound shaper 8 is selected, and only the alert sound is outputted.

With the above constitution, usually, when no alert is to be conveyed to the user, the sound collected by the microphone 1 is subjected to hearing aid processing and outputted from the receiver 5. If an alert is to be conveyed to the user, on the other hand, this sound that has undergone hearing aid processing is switched to sound obtained by subjecting the sound produced by the alert sound producer 7 to the same extent of processing as the hearing aid processing, and this is outputted from the receiver 5.

Thus, in this embodiment, the output signal of the hearing aid processor 3, or the output of the alert sound shaper 8, is switched and outputted by the switching component 30.

Consequently, at the point when the alert sound is outputted, only the unadulterated alert sound can be heard, and this improves the clarity of the alert sound. Thus, it is easier for the user to distinguish between the plurality of alert sounds of the hearing aid, and the conveyed information can be properly recognized.

In other words, the mixer 6 included in the above embodiments is not an essential part of the constitution, so the present invention can also be designated as follows.

A hearing aid of the present invention comprises:

a microphone configured to collect ambient sounds;

an A/D converter configured to convert an analog signal outputted from the microphone into a digital signal;

a hearing aid processor configured to perform hearing aid processing on the digital signal outputted from the A/D converter;

a D/A converter configured to convert the signal that has undergone the hearing aid processing into an analog signal;

a receiver configured to output the analog signal outputted from the D/A converter as an acoustic signal to the surroundings;

an alert sound producer configured to produce an alert sound according to a specific condition;

an alert sound shaper configured to shape the alert sound signal produced by the alert sound producer;

a switching component configured to have at least three input components and one output component, in which the first input component is connected to the output of the hearing aid processor, the second input component is connected to the output of the alert sound shaper, and the output component is connected to the D/A converter; and a controller configured to select the output of the hearing aid processor or the alert sound shaper and decide whether to output, in which its own output is connected to the third input component of the switching component, wherein the alert sound shaper has a table converter that outputs a gain table used in the hearing aid processing of the hearing aid processor after converting for alert sound signal use, an alert gain decider for deciding an alert gain corresponding to an alert sound signal from the output signal of the table converter, and a multiplier that applies the alert gain outputted from the alert gain decider to the alert sound signal outputted from the alert sound producer.

Furthermore, a hearing aid of the present invention comprises:

a microphone configured to collect ambient sounds;

an A/D converter configured to convert an analog signal outputted from the microphone into a digital signal;

a hearing aid processor configured to perform hearing aid processing on the digital signal outputted from the A/D converter;

a D/A converter configured to convert the signal that has undergone the hearing aid processing into an analog signal;

a receiver configured to output the analog signal outputted from the D/A converter as an acoustic signal to the surroundings;

an alert sound producer configured to produce an alert sound according to a specific condition;

a switching component configured to have at least three input components and one output component, in which the first input component is connected to the output of the hearing aid processor, the second input component is connected to the output of the alert sound shaper, and the output component is connected to the D/A converter; and a controller configured to select the output of the hearing aid processor or the alert sound shaper and decide whether to output, in which its own output is connected to the third input component of the switching component, wherein the hearing aid processor has:

a frequency analyzer configured to perform frequency analysis on the digital signal inputted to the hearing aid processor, and output the result as a frequency information signal;

a gain adjuster configured to adjust the gain of the frequency information signal outputted from the frequency analyzer;

a frequency combiner configured to combine the frequency information signal that has undergone gain adjustment with the gain adjuster into a time axis signal;

a power calculator to which the frequency information signal outputted from the frequency analyzer is inputted, and that calculates a power value for the digital signal inputted to the frequency analyzer from the frequency information signal; and a gain controller to which the power value outputted from the power calculator is inputted, and that decides the gain at the gain adjuster on the basis of this power value and outputs it to the gain adjuster, and the gain controller has:

a table memory configured to store a plurality of gain tables for performing hearing aid processing on ambient sounds collected by the microphone, and alert sound tables for performing hearing aid processing on the alert sound signals produced by the alert sound producer;

a table selector configured to read from the table memory either the gain tables or the alert sound tables according to the mixing situation at the mixer; and a gain decider that decides the gain at the gain adjuster on the basis of the power value outputted from the power calculator by using the gain tables or the alert sound tables read by the table selector.

INDUSTRIAL APPLICABILITY

The hearing aid pertaining to the present invention improves the clarity of an alert sound regardless of the characteristics of each user, so it is also useful in acoustic devices that convey information to the user by sound.

EXPLANATION OF REFERENCE

1 microphone
2 A/D converter
3 hearing aid processor
4 D/A converter
5 receiver
6 mixer
7 alert sound producer
8 alert sound shaper
9 controller
10 frequency analyzer
11 gain adjuster
12 frequency combiner
13 power calculator
14 gain controller
15 table converter
16 offset memory
17 alert gain decider

18 multiplier
19 hearing aid processor
20 gain controller
21 table memory
22 table selector
23 gain decider
30 switching component
31 controller

The invention claimed is:

1. A hearing aid, comprising:

a microphone configured to collect ambient sounds;

an A/D converter configured to convert an analog signal outputted from the microphone into a digital signal;

a hearing aid processor configured to perform hearing aid processing on the digital signal outputted from the A/D converter;

a D/A converter configured to convert the signal that has undergone the hearing aid processing into an analog signal;

a receiver configured to output the analog signal outputted from the D/A converter as an acoustic signal to the surroundings;

an alert sound producer configured to produce an alert sound according to a specific condition;

an alert sound shaper configured to shape the alert sound signal produced by the alert sound producer;

a mixer that is provided between the hearing aid processor and the D/A converter, in which a first input is connected to the output of the hearing aid processor, a second input is connected to the output of the alert sound shaper, and its own output is connected to the input of the D/A converter; and a controller that produces a mix ratio signal used by the mixer to combine the output signals of the hearing aid processor and the alert sound shaper in a specific mix ratio, and that is connected to the mix ratio signal input terminal of the mixer, wherein the alert sound shaper has a table converter that outputs a gain table used in the hearing aid processing of the hearing aid processor after converting for alert sound signal use, an alert gain decider configured to decide an alert gain corresponding to an alert sound signal from the output signal of the table converter, and a multiplier that applies the alert gain outputted from the alert gain decider to the alert sound signal outputted from the alert sound producer.

2. The hearing aid according to claim 1, wherein the alert sound shaper has an offset memory configured to store an offset amount for adding a different characteristic to each alert sound signal, and the alert gain decider decides the alert gain corresponding to the alert sound signal on the basis of the offset amount outputted from the offset memory and the output signal of the table converter.

3. The hearing aid according to claim 1, wherein the alert sound producer produces a plurality of kinds of sound of different frequency and sound generation intervals as alert sound signals.

4. The hearing aid according to claim 1, wherein the mixer changes the mix ratio of the two signals inputted to the mixer when the alert sound is generated, and returns to the original mix ratio upon completion of the generation of the alert sound.

5. The hearing aid according to claim 1, wherein the alert sound producer produces an alert sound signal with a volume corresponding to the sound pressure level of the digital signal outputted from the A/D converter.

6. The hearing aid according to claim 1, wherein the alert sound producer decides the frequency of the alert sound signal so that it will be different from the frequency of the digital signal outputted from the A/D converter.

7. The hearing aid according to claim 1, wherein the alert sound producer produces an alert sound signal and generates an alert sound at a timing at which there is little effect of ambient sound, according to the digital signal outputted from the A/D converter.

8. The hearing aid according to claim 7, wherein the timing at which there is little effect of ambient sound is an interval in which the sound pressure level of the digital signal outputted from the A/D converter is low.

9. The hearing aid according to claim 7, wherein the timing at which there is little effect of ambient sound is a non-voice interval with respect to a voice interval detected on the basis of the digital signal outputted from the A/D converter.

10. The hearing aid according to claim 2, wherein the alert sound producer produces a plurality of kinds of sound of different frequency and sound generation intervals as alert sound signals.

11. A hearing aid, comprising:

a microphone configured to collect ambient sounds;

an A/D converter configured to convert an analog signal outputted from the microphone into a digital signal;

a hearing aid processor configured to perform hearing aid processing on the digital signal outputted from the A/D converter;

a D/A converter configured to convert the signal that has undergone the hearing aid processing into an analog signal;

a receiver configured to output the analog signal outputted from the D/A converter as an acoustic signal to the surroundings;

an alert sound producer configured to produce an alert sound according to a specific condition;

a mixer that is provided between the hearing aid processor and the A/D converter, in which a first input is connected to the output of the A/D converter, the alert sound signal is inputted to a second input, and its own output is connected to the input of the hearing aid processor; and a controller that produces a mix ratio signal used by the mixer to combine the output signals of the A/D converter and the alert sound producer in a specific mix ratio, and that is connected to the mix ratio signal input terminal of the mixer, wherein the hearing aid processor has:

a frequency analyzer configured to perform frequency analysis on the digital signal inputted to the hearing aid processor, and output the result as a frequency information signal;

a gain adjuster configured to adjust the gain of the frequency information signal outputted from the frequency analyzer;

a frequency combiner configured to combine the frequency information signal that has undergone gain adjustment with the gain adjuster into a time axis signal;

a power calculator to which the frequency information signal outputted from the frequency analyzer is inputted, and that calculates a power value for the digital signal inputted to the frequency analyzer from the frequency information signal; and a gain controller to which the power value outputted from the power calculator is inputted, and that decides the gain at the gain adjuster on the basis of this power value and outputs it to the gain adjuster, and the gain controller has:

a table memory configured to store a plurality of gain tables for performing hearing aid processing on ambient sounds collected by the microphone, and alert sound tables for performing hearing aid processing on the alert sound signals produced by the alert sound producer;

a table selector configured to read from the table memory either the gain tables or the alert sound tables according to the mixing situation at the mixer; and a gain decider that decides the gain at the gain adjuster on the basis of the power value outputted from the power calculator by using the gain tables or the alert sound tables read by the table selector.

12. The hearing aid according to claim 11, wherein the alert sound producer produces a plurality of kinds of sound or voice of different frequency and sound generation intervals as alert sound signals.

13. The hearing aid according to claim 11, wherein the mixer changes the mix ratio of the two signals inputted to the mixer when the alert sound is generated, and returns to the original mix ratio upon completion of the generation of the alert sound.

14. The hearing aid according to claim 11, wherein the alert sound producer produces an alert sound signal with a volume corresponding to the sound pressure level of the digital signal outputted from the A/D converter.

15. The hearing aid according to claim 11, wherein the alert sound producer decides the frequency of the alert sound signal so that it will be different from the frequency of the digital signal outputted from the A/D converter.

16. The hearing aid according to claim 11, wherein the alert sound producer produces an alert sound signal and generates an alert sound at a timing at which there is little effect of ambient sound, according to the digital signal outputted from the A/D converter.

* * * * *